US009074807B2

(12) United States Patent
Borgonovo et al.

(10) Patent No.: US 9,074,807 B2
(45) Date of Patent: Jul. 7, 2015

(54) RECLOSABLE COMPARTMENT FOR REFRIGERATOR

(75) Inventors: Alberto Borgonovo, Comerio (IT); Fabio Moneta, Comerio (IT)

(73) Assignee: Whirlpool Corporation, Benton Harbor, MI (US)

( * ) Notice: Subject to any disclaimer, the term of this patent is extended or adjusted under 35 U.S.C. 154(b) by 1 day.

(21) Appl. No.: 13/994,139

(22) PCT Filed: Nov. 22, 2011

(86) PCT No.: PCT/EP2011/070669

§ 371 (c)(1), (2), (4) Date: Jul. 9, 2013

(87) PCT Pub. No.: WO2012/079925

PCT Pub. Date: Jun. 21, 2012

(65) Prior Publication Data

US 2013/0278128 A1 Oct. 24, 2013

(30) Foreign Application Priority Data

Dec. 16, 2010 (IT) ..... VA2010A0094

(51) Int. Cl.
*F25D 23/00* (2006.01)
*F25D 23/04* (2006.01)
*F25D 23/12* (2006.01)

(52) U.S. Cl.
CPC ..... *F25D 23/00* (2013.01); *F25D 23/123* (2013.01); *F25D 23/04* (2013.01)

(58) Field of Classification Search
CPC ..... F25D 23/00; F25D 23/02; F25D 23/028; F25D 23/04; F25D 23/13; F25D 23/123; F25D 2500/02
USPC ..... 312/405, 405.1, 321.5, 326, 327, 328, 312/329, 322
See application file for complete search history.

(56) References Cited

U.S. PATENT DOCUMENTS 2,012,262 A * 8/1935 Forsthoefel ..... 312/271
2,576,691 A * 11/1951 Money ..... 312/405.1

(Continued)

FOREIGN PATENT DOCUMENTS

DE 102008018009 A1 10/2009
EP 2131125 A2 12/2009
KR 1020040069726 A 8/2004

OTHER PUBLICATIONS

International Patent Application No. PCT/EP2011070669 filed Nov. 22, 2011., Applicant: Whirlpool Europe SrL, International Publication No. 2012079925A1 published Jun. 21, 2012.

(Continued)

*Primary Examiner* — Daniel J Troy
*Assistant Examiner* — Andrew Roersma

(57) ABSTRACT

Reclosable compartment for refrigerators, particularly suitable for incorporation in removable shelves, openable and reclosable by means of a front cover (30) which is rotatable around a first set of pins (70) on the lateral portions (50, 60) of the said container. In the closed configuration at least one portion of this front cover (30) is in a substantially vertical position, while in the open configuration the said portion (30) is in a substantially horizontal position. The said container also has an auxiliary upper cover (40) rotationally coupled to the lateral portions (50, 60), and rotatable around a second set of pins (80) during its opening and/or closing movement, through contact with the said front cover (30).

13 Claims, 3 Drawing Sheets

(56) References Cited

U.S. PATENT DOCUMENTS

Figure 1:
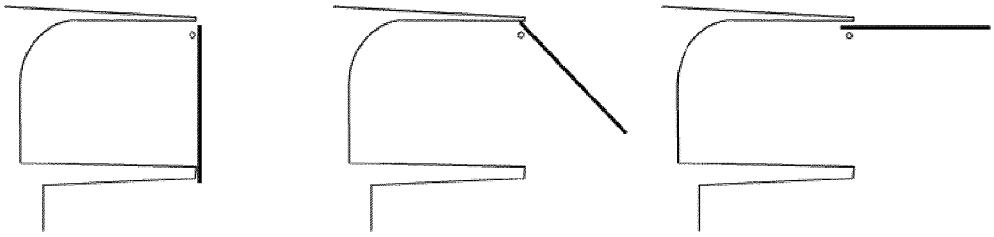

| | | | | |
|---|---|---|---|---|
| 2,783,030 | A * | 2/1957 | Solley, Jr. | 165/61 |
| 3,874,552 | A * | 4/1975 | Grimm | 312/405 |
| 4,186,978 | A * | 2/1980 | Thomson | 312/321.5 |
| 5,639,149 | A * | 6/1997 | Grassmuck | 312/116 |
| 6,074,030 | A * | 6/2000 | Prunty et al. | 312/404 |
| 6,834,922 | B2 * | 12/2004 | Cho | 312/331 |
| 7,254,958 | B2 * | 8/2007 | Kim et al. | 62/265 |
| 7,472,974 | B2 * | 1/2009 | Czach et al. | 312/405.1 |
| 2008/0203876 | A1 * | 8/2008 | Lim et al. | 312/405 |
| 2008/0246381 | A1 | 10/2008 | Kim | |
| 2010/0219731 | A1 * | 9/2010 | Candeo et al. | 312/404 |

OTHER PUBLICATIONS

International Patent Application No. PCT/EP2011070669 filed Nov. 22, 2011., Applicant: Whirlpool Europe SrL Written Opinion of the International Searching Authority, mail date Jan. 30, 2012.

* cited by examiner

RECLOSABLE COMPARTMENT FOR REFRIGERATOR

The subject of the present invention is a closable container for refrigerators, which can contain and enclose items to be preserved, such as food and drink. In particular, the subject of the present invention is a closable container which is easy to use in a refrigerator and which has an available covered volume which is increased compared with known solutions.

The prior art includes refrigerators fitted with containers, in particular shelves located on the inner portion of the door, known as the inner door, fitted with a removable cover or a pivoting front door. As is well-known, a pivoting shelf opening saves the user from having to remove a cover, allowing him to simply open it with one hand while leaving the other hand free to operate in the open compartment. The pivoting openings of known types, such as that shown in FIG. 1, have a door at the front of the shelf which is hinged in seats transversal to the direction of opening and around which the door can be rotated. In this embodiment, the door returns to the closed position by gravity, making it necessary to use both hands for the introduction or removal of products. In other known configurations, such as the one shown in FIG. 2, where the mechanism is balanced and can be operated with one hand, the pivoting door consists of a front portion joined to an upper portion at a substantially perpendicular angle to the latter. The size of the compartment lid, when rotated backwards for opening, decreases the total usable volume of the covered shelf. This limitation affects in particular the maximum height and/or depth of the items which can be inserted in the reclosable shelf, due to the fact that the lid opening position is reached following its rotation around pins whose location is within the compartment. The maximum usable depth in the compartment is limited by the radius of rotation of the innermost part of the cover.

Hinging the compartment door in a location outside the volume of the compartment itself would deprive the shelf of its characteristics of compactness and modularity, which are necessary to position the shelf in different locations within the refrigerator, in particular in shelves located on or incorporated in the inner door.

Figure 3:
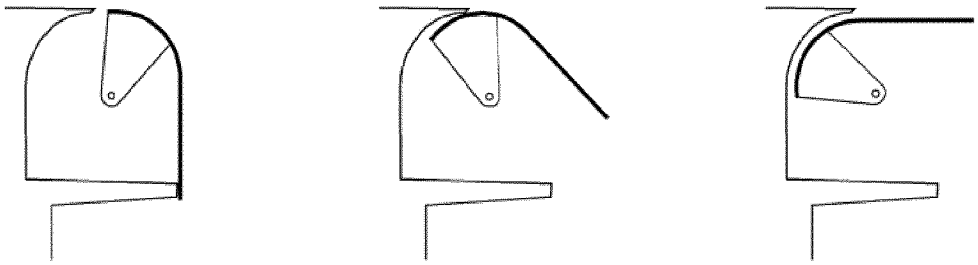

Also known in the prior art are closable compartments with a front portion of the cover having a curved geometry and which can be rotated backwards, such as the one shown in FIG. 3, whose shape corresponds to that of a static rear portion of the container cover. The container is opened by rotating the movable front portion backwards, overlapping the rear portion, allowing access to the compartment. In this solution also, the usable depth of the compartment is limited by the size of the rear part of the moveable cover in its open configuration.

Figure 2:
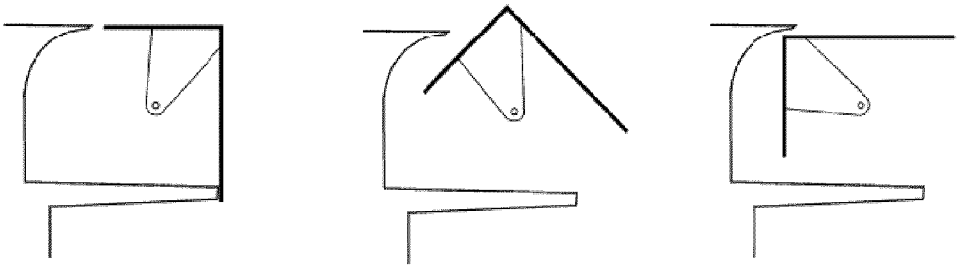
Figure 4:
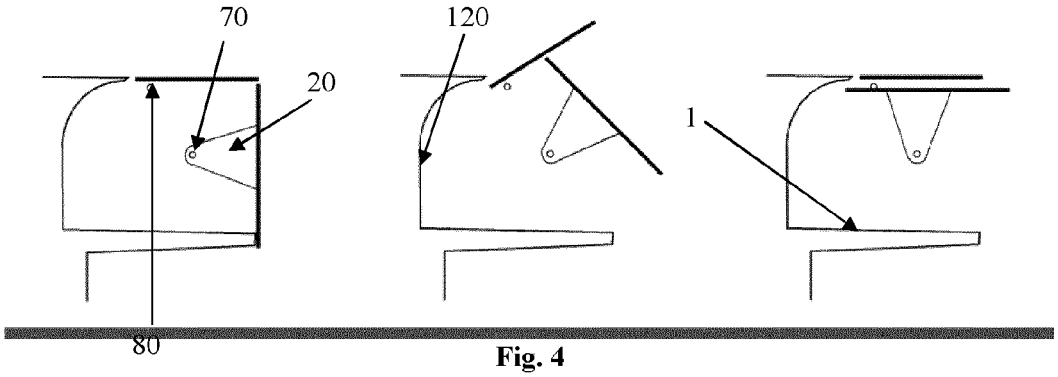
Figure 5:
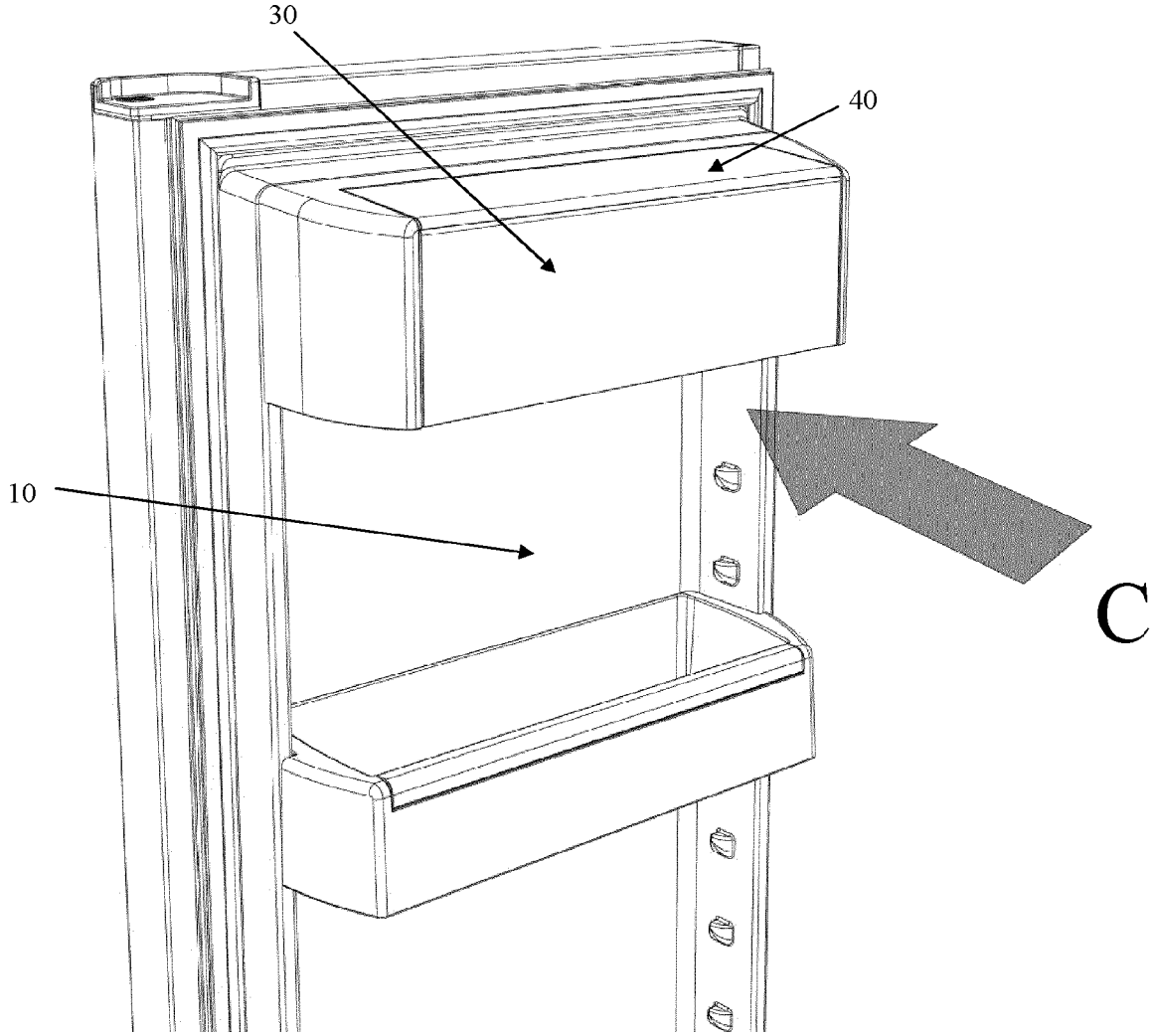
Figure 6:
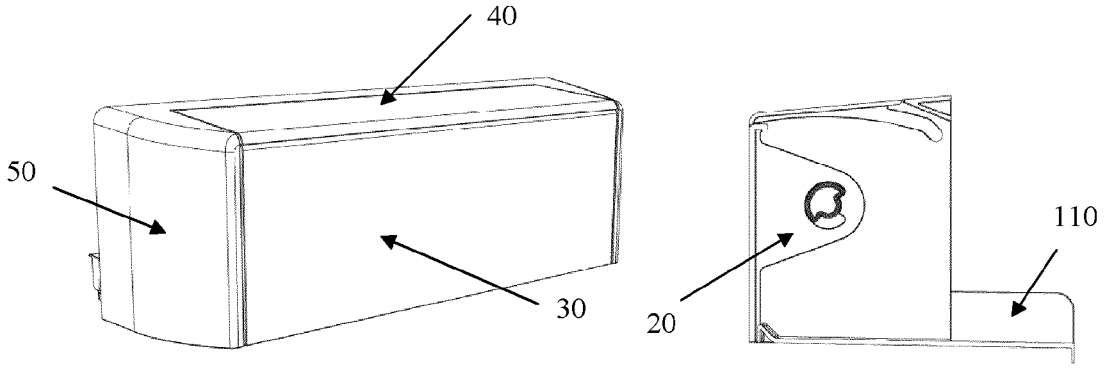
Figure 7:
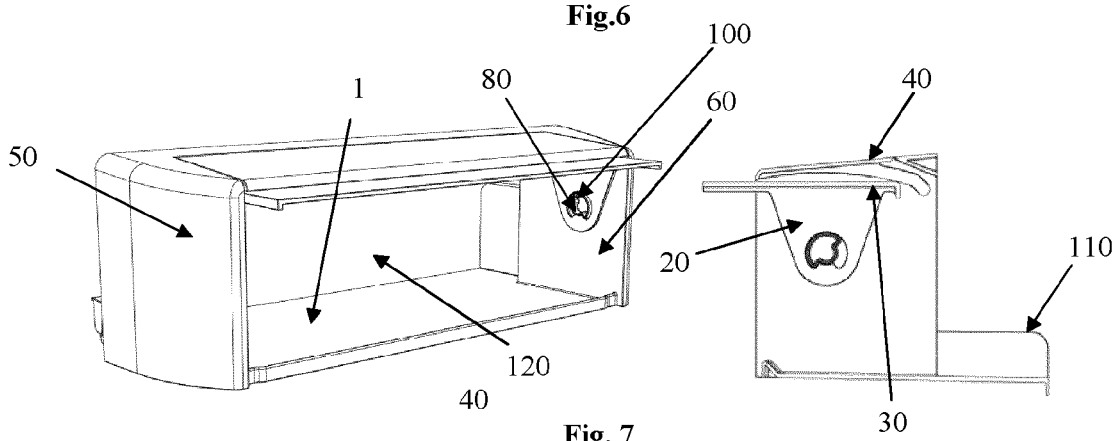
Figure 8A:
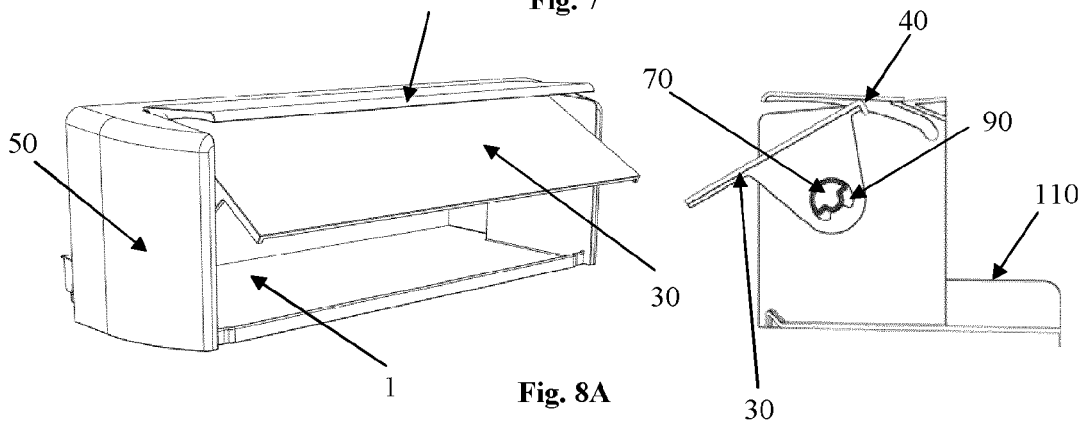
Figure 8B:
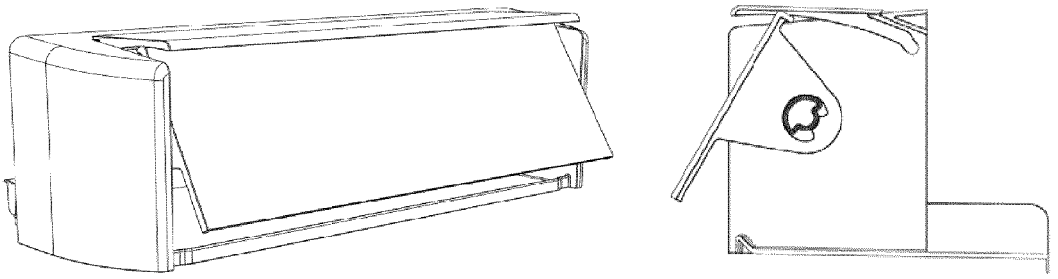

The purpose of the present invention is to provide a closable compartment for a refrigerator, preferably incorporated into a shelf which can be attached to the inner door, fitted with a pivoting cover allowing better use of the compartment and the usable covered space inside the compartment, in particular a greater usable volume. This purpose is achieved by the characteristics listed in the attached claims. Additional advantages and characteristics of a compartment according to the claim will become clear from the following detailed description, which is provided purely as a non-limiting example, with reference to the attached drawings in which:

FIG. 1 is a sectional view of the different positions of a container known in the art provided with a frontal pivoting opening, FIG. 2 is a sectional view of the different positions of a container known in the art with increased depth, provided with a front cover having a square section, FIG. 3 is a sectional view similar to FIG. 2 in which the container known in the art is provided with a front cover having a curvilinear section, FIG. 4 is a sectional view of the different positions of a container according to the invention, incorporated into a shelf of a refrigerator door, and FIGS. 5-8 are perspective and sectional views of the container in FIG. 4 in the different configurations of use.

The description with reference to the said figures describes a closable container C according to the invention, incorporated into a removable shelf attached to the inner door (10) of a refrigerator. The said container C has a flat lower portion (1) to support the articles to be contained, two side portions (50, 60) integral with the said lower portion (1) and including means of attachment (110) to the inner door (10). In addition, the two side portions (50, 60) include a first pair of seats (90) for housing pins for the rotational coupling of a front cover (30) and a second pair (100) for housing pins for the rotational coupling of an upper cover (40).

In the assembled and closed configuration of the container C, a flat cover (40) is placed in the upper region of the container and a front cover (30) is placed at the frontal closure of the same. The said front cover (30) is provided with a first pair of pins (70) designed to cooperate rotationally with the corresponding first housing seats (90) located in the lateral portions (50, 60).

The upper cover (40) also has at its ends a second pair of pins (80) designed to cooperate rotationally with the corresponding second housing seats (100) located in the lateral portions (50, 60).

Preferably, the said second pair of seats (100) and pins (80) are positioned in the lateral portions (50, 60) at a higher position with respect to the said first pair of seats (90) and pins (70), placing the axis of rotation of the upper cover (40) above the axis of rotation of the front cover (30).

Preferably, in an assembled configuration the first pair of pins (70) and seats (90) are placed and/or integrated centrally in flanges (20) located at the ends of the said front cover (30) and extend in planes perpendicular to the surface of the said front cover (30).

Alternatively, the said pins and seats may be realised in a complementary way with respect to the foregoing, whereby the front cover (30) and upper cover (40) may be fitted with seats designed to cooperate with pins integral with the side portions (50, 60), or the said covers (30, 40) may be coupled rotationally to the said lateral portions (50, 60) in different ways but producing an essentially equivalent result.

The container C may have a rear closing wall (120), which may also be provided by the inner door (10) of the refrigerator.

In the closed configuration of the container (FIGS. 5 and 6), the front cover (30) is placed perpendicular to the flat portion (1) and the upper cover (40) is placed at the upper closure of the enclosed volume between the flat portion (1) and the front cover (wall) (30).

In the open configuration of the container (FIG. 7) the front cover (30) is rotated into a position almost parallel to the flat portion (1), offering the possibility of frontally inserting food or other items to be preserved and exploiting to the full the maximum depth of the volume of the covered compartment.

During the transition movement from the closed position to the open position of the compartment (FIGS. 8A and 8B), the front cover (30), rotating around the first pair of pins (70), comes into contact with the upper cover (40). This contact causes rotation of the upper cover (40) around the corresponding second pins (80) thus raising the cover (40) until the front cover (30) is entirely contained within the volume of the compartment and it reaches a stable open position.

When the front wall is returned to the frontal position, contact with the front cover similarly causes a rotation of its wall (30) around the corresponding second pins (80), thus raising the upper cover (40) until the front cover reaches a position substantially perpendicular to the flat portion (1) in the closed position.

Elastic components and movement guides may optionally be provided to better guide the movements and/or further improve the sealing of the compartment. To this end, seals may be inserted. Ventilation or air ducting components may be included.

According to the invention, the configuration of the covering components (40) and (30) allows for containers with a depth greater than those hitherto known in the art, increasing the available covered volume. In addition, the user can also open the compartment in a simplified manner without the need to use both hands, due to the fact that, in the open configuration of the container, the upper cover (40), due to its weight, stabilises the open position of the wall (30). Furthermore, the solution according to the invention offers a compact, simplified and versatile design of the compartment which, individually or integrated into a shelf, could be easily repositioned within the whole of the refrigerator according to the requirements of the user.

The invention claimed is:

1. A refrigerator container comprising:

a pair of lateral portions;

a shelf for the storage of items to be preserved;

a front cover having a first pair of pins corresponding to the pair of lateral portions of the refrigerator container, the front cover configured to be rotated around the first pair of pins, wherein the refrigerator container is in a closed configuration when the front cover is in a substantially vertical position and the refrigerator container is in an open configuration when the front cover is in a substantially horizontal position; and an auxiliary upper cover having a second pair of pins, the auxiliary upper cover rotationally coupled to the pair of lateral portions, the auxiliary cover configured to be rotatable around the second pair of pins through contact with the front cover, the front cover having a boundary in sliding contact along substantially a length of a bottom surface of the auxiliary upper cover, which rotates a front edge of the auxiliary upper cover upward as the front cover rotates between the vertical and horizontal positions;

the pair of lateral portions include a first pair of seats which house the first pair of pins, the pair of lateral portions include a second pair of seats which house the second pair of pins, wherein the first pair of pins are integrally formed in the front cover and the second pair of pins are integrally formed in the auxiliary upper cover.

2. The refrigerator container according to claim 1, wherein an axis of rotation of the auxiliary upper cover is above an axis of rotation of the front cover.

3. The refrigerator container of claim 1, wherein when the refrigerator container is in the closed configuration, the upper cover is positioned at an upper closure of an enclosed volume between the shelf and the front cover.

4. The refrigerator container of claim 1, wherein while the refrigerator container is in the open configuration, the auxiliary upper cover comprises a portion that overlaps the front cover.

5. The refrigerator container of claim 1, further comprising one or more movement guides designed to guide the movements of the refrigerator container.

6. The refrigerator container of claim 1, further comprising at least one seal interposed between the front cover and the auxiliary upper cover.

7. The refrigerator container of claim 1, wherein the lateral portions are integral to the shelf and wherein the lateral portions are configured to couple to an inside surface of a portion of the refrigerator.

8. The refrigerator container according to claim 1, in which the first pair of pins are located in a central position in flanges placed at ends of the front cover, the flanges extending in planes perpendicular to a front portion of the front cover.

9. A refrigerator container, comprising:

a first surface and a second surface each having an engagement element configured to engage an interior portion of a refrigerator, wherein the first surface is substantially parallel to the second surface, and a storage shelf disposed between a bottom portion of the first surface and a bottom portion of the second surface;

a front cover rotatably connected to the first and second surfaces and rotating between a first vertical position and a second horizontal position;

an upper cover rotatably connected to the first and second surfaces and configured for rotational movement through contact with the front cover as the front cover is moved between the first vertical position and the second horizontal position, the front cover having a boundary in sliding contact along substantially a length of a bottom surface of the upper cover, which rotates the upper cover as the front cover rotates, a front edge of the upper cover rotating upward as the front cover begins to rotate from the first vertical position to the second horizontal position;

the first surface and the second surface each include a first seat and a second seat, the front cover includes a pair of first pins, and the upper cover includes a pair of second pins;

the pair of first pins are rotatably engaged with the first seats, thereby defining a first axis of movement, wherein the pair of second pins are rotatably engaged with the second seats, thereby defining a second axis of movement.

10. The refrigerator cover of claim 9, wherein the front cover first vertical position is a substantially vertical position, and the front cover first vertical position is substantially closed.

11. The refrigerator cover of claim 9, wherein the front cover second horizontal position is a substantially horizontal position, and the front cover second horizontal position is a fully open position.

12. The refrigerator container of claim 9, wherein the first surface and second surface are integral to the storage shelf.

13. A refrigerator container comprising:

a base having a back portion, a plurality of engagement members, a first side wall, and a second side wall, wherein the first side wall and the second side wall are substantially parallel to each other; and wherein the first side wall and the second side wall each have corresponding first and second seats, the second seats on a rearward portion of the first and second side walls;

a first cover having a first pair of pins rotatably engaged with the first seats on the first side wall and the second side wall defining a first axis of movement between a vertical closed position and a horizontal open position; and a second cover having a second pair of pins rotatably engaged with the second seats on the first side wall and the second side wall defining a second axis of movement, wherein the second axis of movement is higher than the first axis of movement; and wherein the second cover is configured to cover the top of the refrigerator container when the first cover is in the closed position, and rotate about the second axis through contact with the first cover as the first cover is rotated between the closed position and the open position, wherein the front cover having a boundary in sliding contact along substantially a length of a bottom surface of the upper cover, which rotates the upper cover as the front cover rotates.

* * * * *